US005471801A

United States Patent [19]

Kupczyk et al.

[11] Patent Number: 5,471,801

[45] Date of Patent: Dec. 5, 1995

[54] HIP AND RIDGE ASPHALT ROOF COVERING

[75] Inventors: Stephen J. Kupczyk, Fort Worth; Dominic C. Quartier, Red Oak, both of Tex.

[73] Assignee: GS Roofing Products Company, Inc., Irving, Tex.

[21] Appl. No.: 299,568

[22] Filed: Sep. 1, 1994

[51] Int. Cl.[6] ..... E04D 1/30

[52] U.S. Cl. ..... 52/57; 52/518; 52/528; 52/554; 52/555; 52/560; 52/DIG. 16

[58] Field of Search ..... 52/57, 518, 528, 52/554, 555, 560, 748, DIG. 16

[56] References Cited

U.S. PATENT DOCUMENTS

| | | | |
|---|---|---|---|
| 1,633,474 | 6/1927 | Buska | 52/555 |
| 1,848,965 | 11/1929 | Miller . | |
| 1,935,656 | 11/1933 | Mortimer | 52/555 |
| 2,008,575 | 7/1933 | Bussey . | |
| 2,340,038 | 1/1944 | Buczkowski et al. | 52/554 |
| 3,127,701 | 4/1964 | Jastrzemski | 52/518 |
| 3,913,294 | 10/1975 | Freiborg . | |
| 4,404,783 | 9/1983 | Freiborg . | |
| 4,434,589 | 3/1984 | Freiborg . | |
| 4,439,955 | 4/1984 | Freiborg . | |
| 4,768,318 | 9/1988 | Freiborg . | |
| 5,094,042 | 3/1992 | Freborg . | |
| 5,247,771 | 9/1993 | Poplin . | |

*Primary Examiner*—Carl D. Friedman
*Assistant Examiner*—Christopher Todd Kent
*Attorney, Agent, or Firm*—DeLio & Peterson

[57] ABSTRACT

The present invention provides a composition ridge or hip covering which creates an appearance similar to that of a wood shake or slate roof. The covering may be easily installed, requires no trimming or folding during installation and may be manufactured with no significant waste of starting material. The covering is accomplished by forming an unfolded sheet of roofing material into a fish-like shape having three distinct portions: a front portion, a body (middle) portion and an end portion. Each portion is tapered and each portion has a specially defined length and taper angle depending upon the shape of the shingle desired. Two thickened multilayers are formed in the body portion by folding the unfolded sheet, one being at the wide end edge of the shingle and the other in the main part of the body portion. The taper angles and lengths of the front portion and end portion are essentially the same.

12 Claims, 4 Drawing Sheets

HIP AND RIDGE ASPHALT ROOF COVERING

BACKGROUND OF THE INVENTION

1. Field of the Invention

This invention relates to the field of roofing and, more particularly, to hip and ridge roof covers having correlated dimensions which provide a cover having an attractive aesthetic appearance, enhanced installation and design features and which may be made without any significant waste of starting material.

2. Description of Related Art

Roofing for homes and other buildings is very well known in the prior art and a number of different roofing systems such as tiles, wood shakes, slates and asphalt composition shingles have been used. Each type of roofing system has certain features and advantages and a choice is usually made based on a compromise between durability, price and aesthetics. Slate roofs for example, are very durable and attractive, but are very expensive. Tile roofs are also very durable and expensive but are generally suitable for only certain type homes from an aesthetic standpoint.

An asphalt composition roof made up of individual shingles is relatively durable and inexpensive and is the most commonly used today in the industry. This type of roof is relatively flat in appearance however, which is noticeable when used as ridge or hip covers.

This problem with asphalt composition roofs has had considerable attention over the years in an attempt to provide a roof covering which while inexpensive and durable would also have the attractive and aesthetic architectural features of other roofing systems such as slate, tile and wood shakes.

U.S. Pat. No. 3,913,294 provides an asphalt composition ridge cover and method of installation whereby a decorative appearance somewhat resembling that of a shake roof ridge is achieved. The ridge cover generally is a flat, approximately rectangular and continually tapered piece of asphalt composition roofing material which is folded to form portions of increased thickness which, when installed, the thickened portions force the ridges to take the appearance of that of a shake shingle or a tile roof.

Related U.S. Pat. Nos. 4,434,589 and 4,439,955 provide asphalt composition ridge covers whereby a generally flat approximately rectangular piece of asphalt composition roofing has a plurality of tabs at one end which are multiply folded over one another thereby forming a region of increased thickness at that end. The ridge cover gradually thickens from the back of the ridge cover toward the front of the ridge cover and the ridge cover appears at the exposed end four to five times as thick as a conventional asphalt shingle.

U.S. Pat. No. 4,404,783 discloses an asphalt composition roofing design which may be used as a starter piece, edge covering, rake covering and ridge or hip cover. To form a ridge or hip cover, a square piece is folded at multiple fold lines. U.S. Pat. No. 5,094,042 shows another ridge cover design used to shingle houses whereby the cover is constructed from a rectangular sheet of asphalt composition having a plurality of folding tabs.

U.S. Pat. No. 5,247,771 discloses a ridge shingle unit which provides for a multilayer coverage of a ridge or hip of a structure. The ridge cover has a tapered periphery which it is disclosed permits a margin of error in application so that a pleasing contour is achieved without strict adherence to a straight line. In this design a single sheet of roofing material is folded back on itself three times in the center portion to provide a multilayered folded ridge shingle unit.

While asphalt hip and ridge shingles of the prior art have areas of multiple thickness to provide the appearance of that of a wood shake or tile, industry still demands improved shingles which have aesthetic and architectural appeal while at the same time requiring that the shingles be able to be manufactured efficiently with a minimum of waste at the manufacturing site and with no need for trimming of the shingle by the installer at the building site. It is also desired that the shingle be securely attached to the roof without the need for excessive nailing and that the positioning of the shingles be as simple as possible due to the use of generally unskilled roofing labor.

Bearing in mind the problems and deficiency of the prior art, it is a primary object of the present invention to provide an asphalt composition roof covering for hips and ridges having these enhanced properties.

It is another object of the present invention to provide a method for making hip and ridge asphalt composition roof coverings which method has substantially no waste of starting material as a result of the manufacturing process while still producing a covering having enhanced architectural and installation properties.

It is yet another object of the present invention to provide an unfolded sheet of asphalt composition material which can be easily folded to form a hip or ridge cover during manufacture which is aesthetically and architecturally pleasing.

Other objects and advantages of the invention will be readily apparent from the following description.

SUMMARY OF THE INVENTION

The present invention provides an asphalt composition or other similar shingle material such as fiberglass ridge or hip roof covering which creates an appearance similar to that of a shake shingle roof or other roofing systems which have a depth and dimension as a result of their thickness. The covering may also be easily installed and requires no trimming during installation. The covering is also manufactured with no significant waste of starting material.

The shingle of the invention generally is accomplished by cutting an unfolded sheet of roofing material into a fish-like shape having three distinct portions: a front portion, a (middle) body portion and an end portion. One end of the middle portion is adjacent the front portion and the other end of the middle portion is adjacent the end portion. Each portion is tapered and each portion has a specially defined length and taper angle depending on the shape of the shingle desired. Two thickened multilayers are formed in the body portion by folding the unfolded sheet, one being at the wide end edge of the shingle and the other in the main part of the body portion. The taper angles and lengths, of the front portion and end portion are essentially the same with the taper angle and length of the longer body portion depending on the shingle desired. The taper angle of the body portion is preferably less than the taper angles of the front and end portions. The folded shingle has tapered body having a reverse taper (fin) portion at the end of the shingle.

Before the roof shingle is formed into its final form for installation, the invention provides as an article of manufacture an asphalt composition for forming into a roof covering comprising:

an elongated sheet of material having a first end, a second end, a first edge, a second edge, a tapered front portion, a tapered body portion, a tapered end portion and a longitudinal axis;

said elongated sheet preferably being provided with fold lines transverse to the longitudinal axis;

at least a first and preferably a second fold line in the front portion, said second fold line being closer to the first end with the front portion of the sheet being between the first end and the first fold line;

at least a third and a fourth fold line in the body portion of the sheet;

said first end tapering outward to a first juncture of the front portion and the body portion to form the widest part of the sheet;

the elongated sheet tapering inwardly from said first juncture to a second juncture of the body portion and the end portion, which second juncture point is the narrowest part of the sheet, the portion between the first juncture and second juncture being the body portion of the sheet; and the elongated sheet tapering outwardly from the narrowest portion of the sheet to the second end, this portion of the sheet being the end portion.

The above elongated sheet of material is formed into an asphalt composition roof covering by folding the elongated sheet under the body portion about its first fold line and about its other fold lines in the front portion if any and about its third fold line and about its fourth and other fold lines in the body portion if any on top of the body portion to provide multiple layers of said sheet at the wide end of the body portion and in the main part of the body portion. It is preferred to use an adhesive at the folds to hold the folds together and prevent the layers from separating. This is particularly important for the installer of the shingles since there is no need to refold the shingles in the event they become separated during shipment or at the roofing site. Any suitable adhesive such as mastic may be employed with a preferred adhesive being a hot melt asphalt glue having a melting point above about 220° F.

It is an important feature of the invention that the angles of tapers and lengths of the front portion, body portion and end portion are correlated so that when the front portion is folded along the first fold line and under the body portion, the edges of the front portion do not extend beyond the edges of the body portion. It is a further aspect of the present invention that multiple unfolded sheets can be manufactured from a single roll of essentially rectangular starting sheet material with substantially no loss of starting sheet material.

DESCRIPTION OF THE PREFERRED EMBODIMENT(S)

Figure 1:
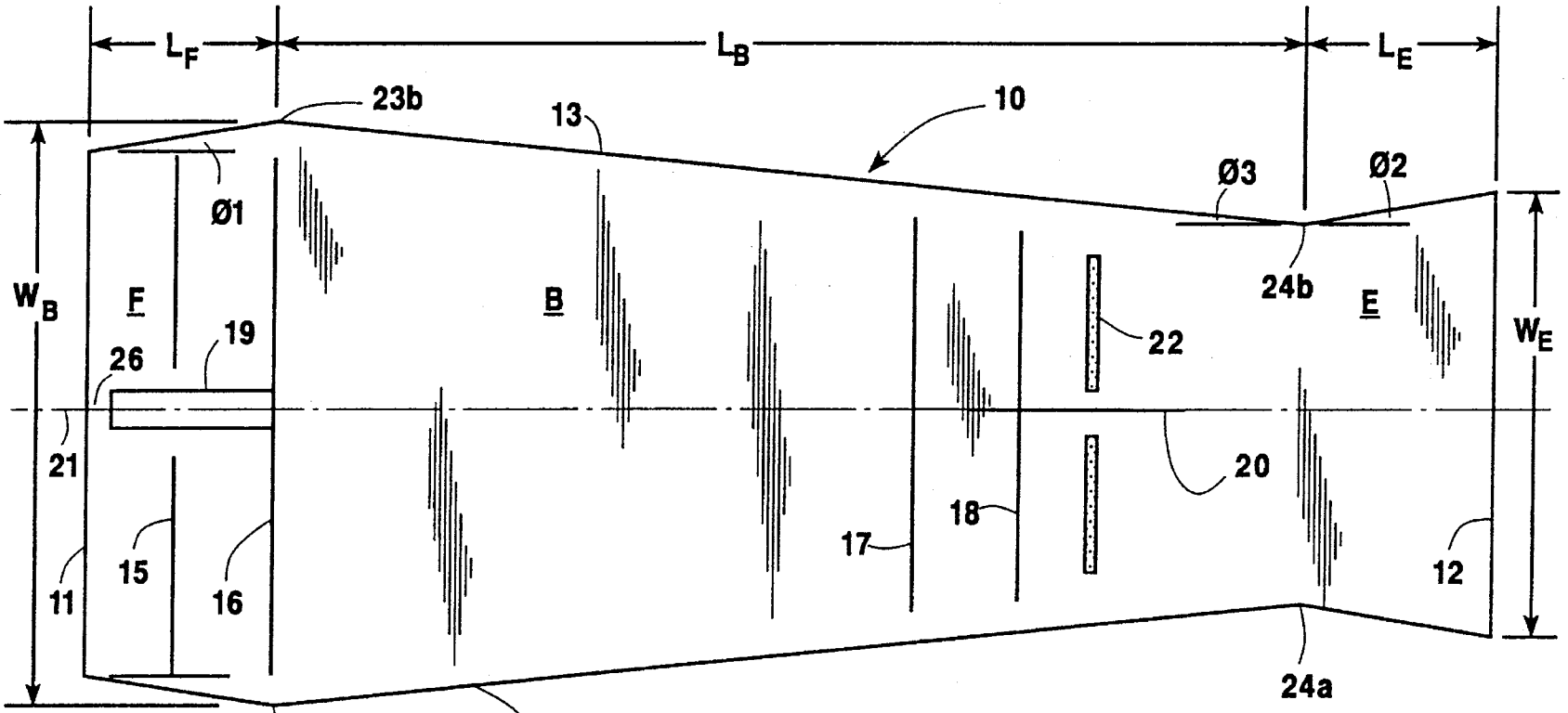
FIG. 1 is a top view of an asphalt composition sheet of material suitable for forming into a roof covering of the invention.

Referring to FIG. 1, an unfolded ridge shingle unit 10 of the present invention is shown. The ridge shingle unit 10 is cut from a roll of commercially available composition roofing material, typically fiberglass, asphalt, polymer modified asphalt or similar material and may have granules or other coverings on the material as is well-known in the art. Polymer modified asphalt is preferred because of its physical properties (flexibility) especially in cold weather. Each ridge shingle unit 10 has a length $L_F+L_B+L_E$ which is generally about 21 inches long although any desired size may be suitably employed. The shingle unit has a first end 11, a second end 12, a first edge 13 and a second edge 14. Center line 21 is shown running longitudinally along the unit 10.

A second transverse fold line is shown at 15 and a first transverse fold line at 16. A fourth transverse fold line is shown at 17 and a third transverse fold line is shown at 18, the third and fourth fold lines being near to the approximate right of the center of the unfolded shingle unit 10 although their position may vary depending upon the desired shingle to be made. A slot 19 and a longitudinal fold line 20 are provided to facilitate folding and bending of the unfolded shingle unit 10. It is preferred that the slot 19 not extend to first end 11 but that first end 11 be continuous with a small portion 26 of the roofing material being maintained in the shingle at that point. This helps maintain the integrity of the shingle and facilitates the folding process in the folding machine. It is also contemplated that the slot 19 extend to first end 11 for certain applications and/or manufacturing requirements. An adhesive wind seal 22 provides additional fastening for the succeeding installed shingle and is usually not applied until after the shingle is folded or during the folding process. Any suitable adhesive such as for the folds may be employed.

The ridge shingle unit 10 includes three portions. A front portion F is bounded by first end 11 and an imaginary line connecting points 23*a* and 23*b* which is preferably at the first fold 16. Body portion B is bounded by an imaginary line connecting points 23*a* and 23*b* and an imaginary line connecting points 24*a* and 24*b* and an end portion E is bounded by an imaginary line connecting points 24*a* and 24*b* and second end 12. It will be noted that each portion has tapered side edges with $\Theta 1$ designating the angle of taper for the front portion F, $\Theta 2$ designating the taper angle in the end portion E and $\Theta 3$ designating the taper angle for the body portion B.

Figure 2:
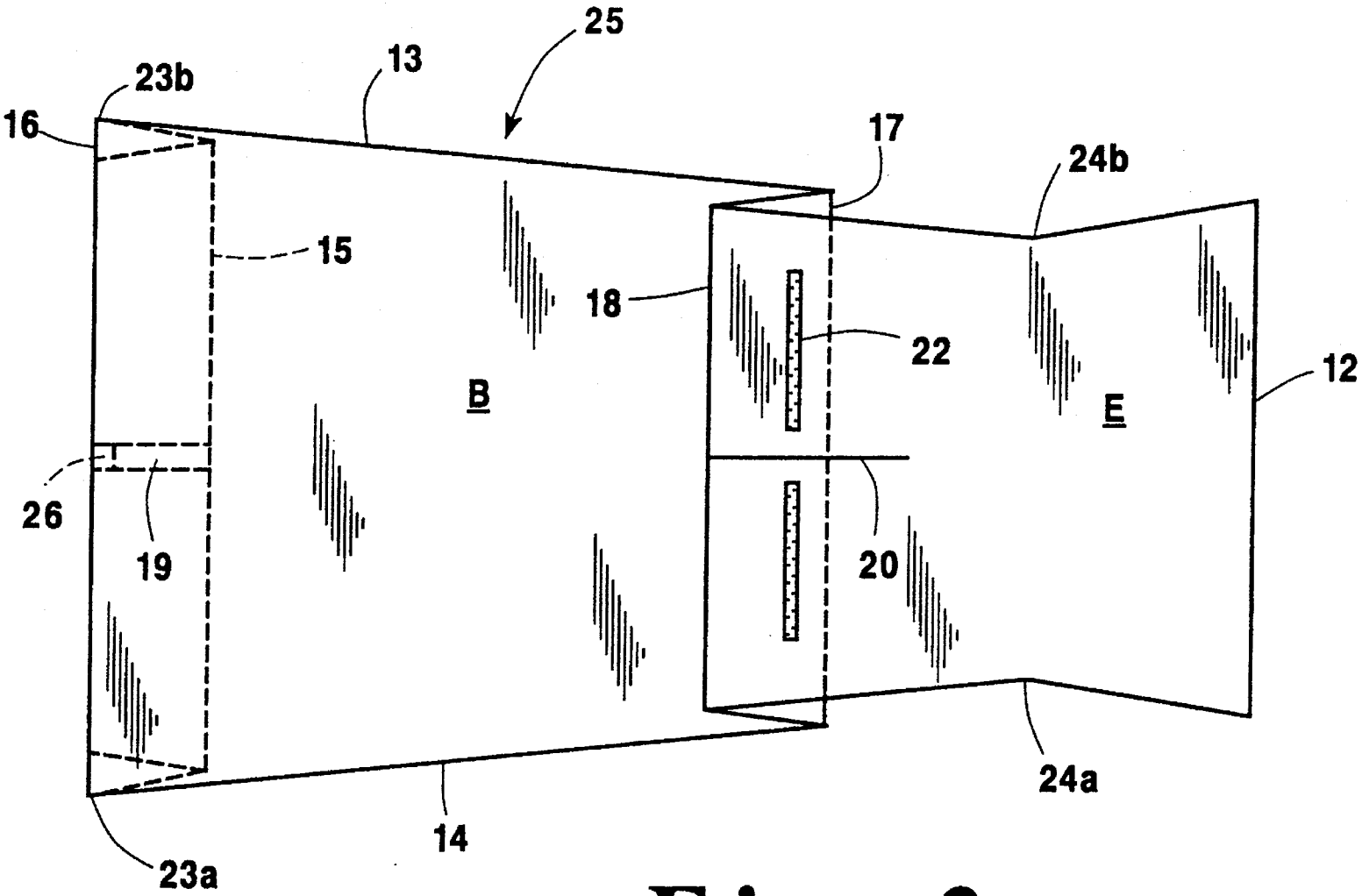
FIG. 2 is a top view of the folded roof covering product formed by folding the sheet of FIG. 1.

The various folds to be made in the unfolded roof cover of FIG. 1 to form the folded roof cover of FIG. 2 may readily be made by automatic equipment operating in synchronism with the cutters cutting out the basic form for the ridge cover, in which case the various fold lines of FIG. 1 may not be marked or otherwise identified on the cover prior to bending. On the other hand, it may be convenient for the fold lines to be identified on the cover before folding by such means as cutting, scoring or indenting the granule and asphalt layer so as to define lines of reduced resistance to bending thereby providing the cover with a natural tendency to bend first along those lines. Short slits have also been used to define lines of reduced resistance to bending, though cutting and/or scoring are preferred as they are easily accomplished and remove any granules used and some asphalt along predetermined lines, thereby not only defining the fold lines but also tending to avoid material build-up in the fold when the cover is folded. In a preferred method of manufacture, two separate steps are used wherein the unfolded roof cover is first cut from a roll of sheet material and stacked and stored. The cut unfolded covers are then folded in a separate operation depending on orders or inventory needs. This method has been found to be more efficient from a manufacturing standpoint.

Regardless of how the sheet 10 is folded and whether or not actual fold lines are used, the sheet is bent into the ridge cover 25 shown in FIG. 2. Thus, the sheet is folded along lines 15 and 16 in the front portion to form a multilayer thickness of the material under the body portion B. Likewise, the sheet is folded at lines 17 and 18 to form a multilayer thickness on top of the body portion B. Longitudinal fold line 20 will aid in folding the ridge cover along its longitudinal axis when ready to be installed.

Referring back to FIG. 1, it is an important aspect of the invention that the lengths of the various portions of the unfolded shingle be correlated together with the angle of taper of each portion to form a finished folded shingle having the desired shingle characteristics. Thus, it is important that the length of the front portion F be substantially the same as the length of the end portion E and also that the angle of taper θ1 of the front portion F be substantially the same as taper angle Θ2 of the end portion E. It is a further important aspect of the invention that the taper angle Θ3 for the body portion B be less than taper angle Θ1 or Θ2. It is also important that the width $W_B$ of the sheet 10 be the widest part of the shingle and that this width be greater than the width $W_E$ of second end 12. When a shingle made in accordance with the above correlations is folded, a shingle having the desired characteristics of FIG. 2 will be obtained and a pleasing decorative and architecturally sound shingle design will be provided together with a method for the manufacture of the shingle in which substantially no sheet material is wasted.

Figure 3:
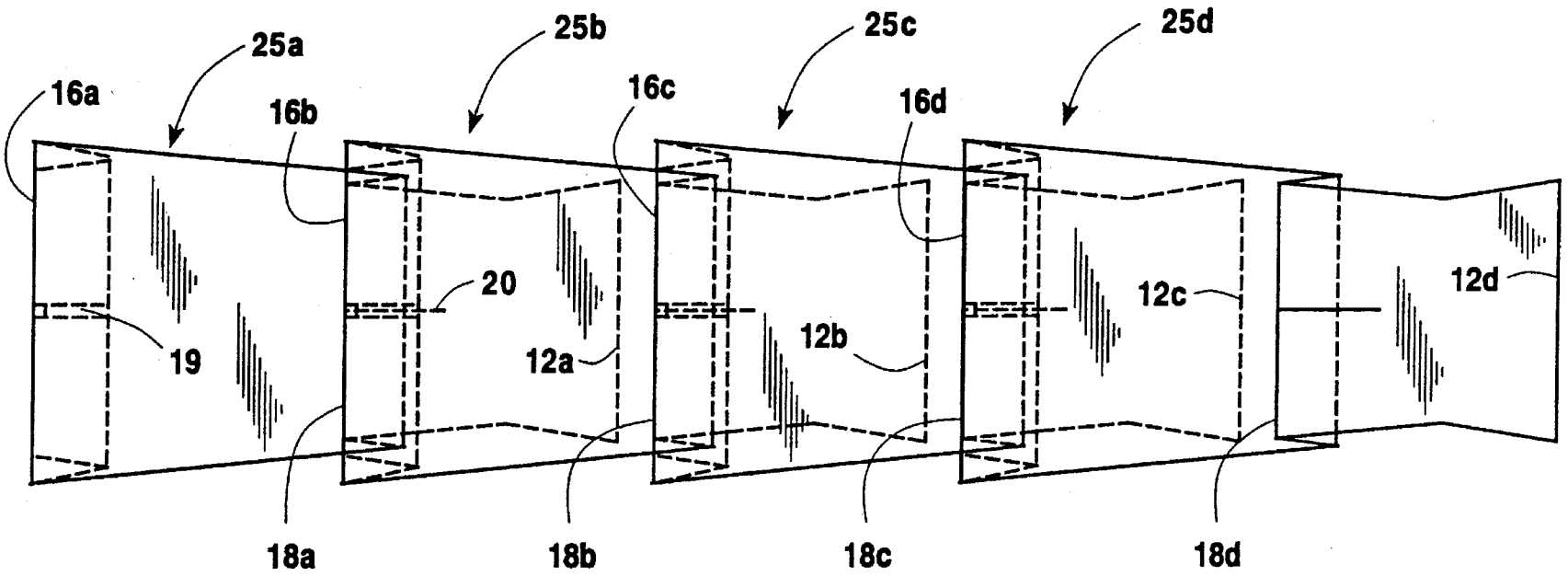
FIG. 3 is a top view of overlapped roof coverings showing the ease of installation.

FIG. 3 shows overlapping installed folded shingles 25*a*, 25*b*, 25*c* and 25*d* which have been specially correlated for the simplicity of installation and the enhanced nailing surface and attachment to the roof structure which may be afforded by the shingles of the invention. Thus, first shingle 25*a* has folded edge 16*a* and folded edge 18*a* and second end 12*a*. The second shingle 25*b*, is placed on top of shingle 25*a* so that folded edge 16*b* is on top of and abuts folded edge 18*a*. There is no question of where the second shingle 25*b* should be positioned and the ease of placement and installation is obvious. Additionally, the tapered second end 12*a* has a wide nailing surface which when nailed provides more secure fastening for the shingle. Likewise, the folded edge 16*c* of third shingle 25*c* overlaps folded edge 18*b* and so on for additional shingles. It will be appreciated that other shingle shapes and designs may provide a different overlapping pattern depending on the balancing of the aesthetics and installation requirements.

Figure 4:
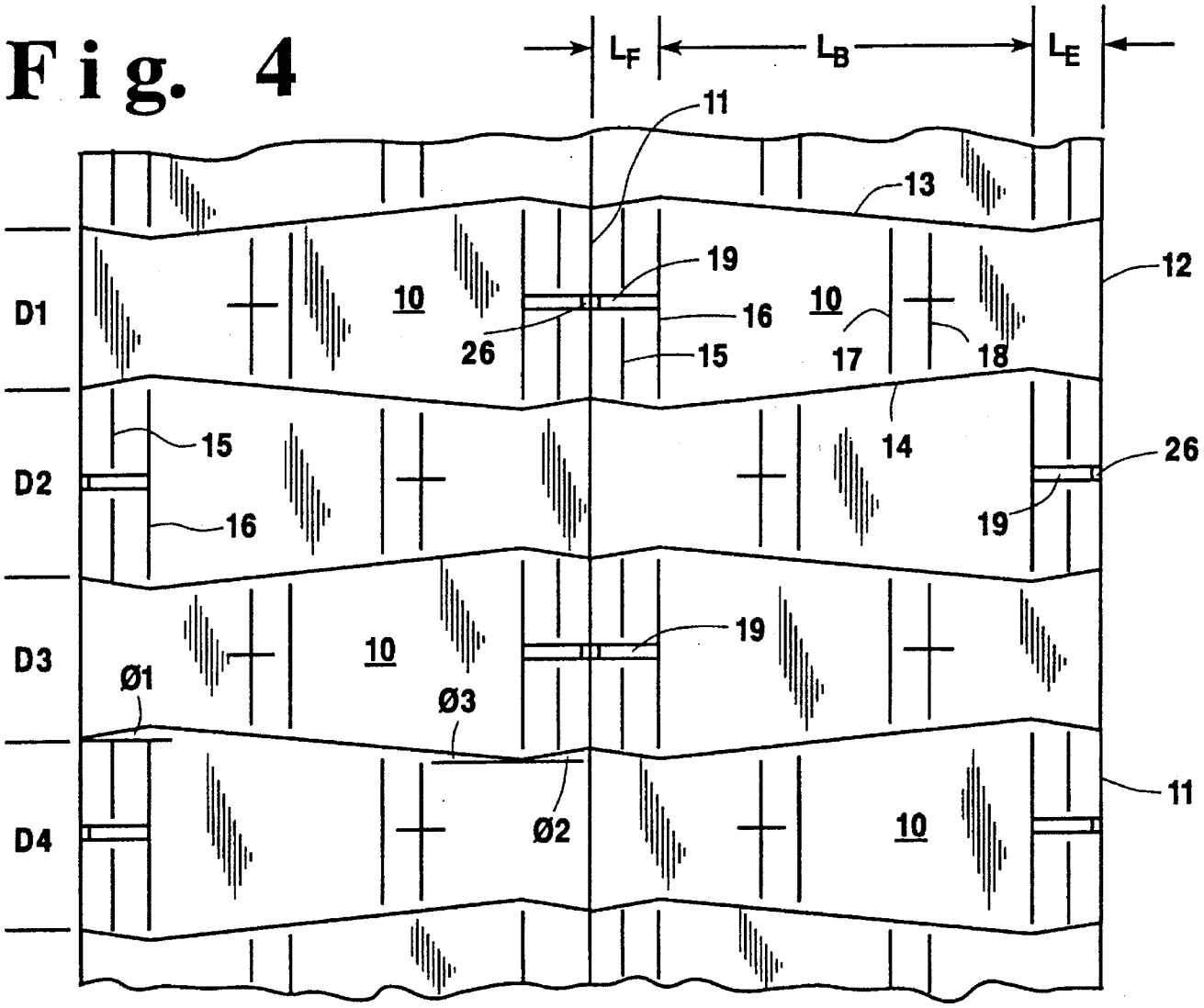
FIG. 4 is a portion of a production roll of asphalt composition material showing the layout for cutting multiple ridge covers therefrom.

With regard to the manufacture of the unfolded shingle 10 of the invention reference to FIG. 4 shows a multiplicity of unfolded shingles 10 being formed from a single roll of rectangular sheet material. It can readily be noted that it is a repeating reverse pattern referring to D1, D2, D3 and D4. Thus, D1 provides two shingles 10 which are joined at their first ends and D2 provides two shingles joined at their second ends. The pattern repeats for D3 and D4. A total of eight full unfolded shingles 10 being shown in FIG. 4. As can be seen in the figure, there is no significant waste of starting material except for the notch 19 material.

The preferred unfolded shingle 10 of the invention has a length of about 21 inches, with an angle Θ1 and Θ2 between about 8° to 12° and a front portion and end portion length of about 3 inches. Angle Θ3 is preferably about 4° to 7°. The width of the shingle $W_B$ is preferably about 9 inches and the width of the second end $W_E$ about 7 inches. Fold lines 17 and 18 are preferably about 8.5 inches and 7 inches respectively from the second end 12.

Many different shingle designs for varying architectural and aesthetic purposes may be made by correlating the taper angles and lengths of the front, body and end portions of the unfolded single 10. There is an inverse relationship between the size of angle Θ3 and the width of $W_E$ of second end 12. Thus, at a particular Θ1 and Θ2 and $L_F$ and $L_E$ increasing Θ3, decreases the width $W_E$. Depending on the roofing shingle desired, the effect of increasing Θ3 allows the shingle to cover more of the preceding shingle when installed This may be important for certain applications.

While the invention has been described with reference to specific embodiments, it will be recognized by those skilled in the art that variations are possible without departing from the spirit and scope of the invention, and that it is intended to cover all such variations of the materials disclosed herein for purpose of illustrations which do not constitute departure from the spirit and scope of the invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. As an article of manufacture an asphalt composition for forming into a roof covering comprising:

an elongated sheet of material having a first end, a second end, a first edge, a second edge, a tapered front portion, a tapered body portion, a tapered end portion and a longitudinal axis;

said first end tapering outward to a first juncture of the front portion and the body portion, said first juncture being the widest part of the sheet, the front portion of the sheet being between the first end and the first juncture;

the elongated sheet tapering inwardly from said first juncture to a second juncture of the body portion and the end portion, which second juncture point is the narrowest part of the sheet, the portion between the first juncture and second juncture being the body portion of the sheet; and the elongated sheet tapering outwardly from the second juncture to the second end, this portion of the sheet being the end portion.

2. The article of claim 1 having a first and a second fold line in the front portion, said second fold line being closer to the first end than the first fold line, and the first fold line being substantially at the juncture of the front portion and body portion.

3. The article of claim 2 having at least a third and a fourth fold line in the body portion of the sheet.

4. The article of claim 1 wherein the angle of tapers of the front portion and end portion are substantially the same and wherein the length of the front portion and end portion are substantially the same.

5. The article of claim 4 wherein the angle of taper of the body portion is less than the angle of taper of the front portion or end portion.

6. A method for making multiple articles of claim 1 from a rectangular sheet of material having a longitudinal center line comprising forming a pattern on the sheet having alternating rows of two articles each, the first row having two articles joined at the centerline at their first ends, the second row having two articles joined at the centerline at their second ends, and repeating the above alternating pattern on the rectangular sheet of material.

7. The method of claim 6 wherein the angle of tapers of the front portion and end portion are substantially the same and wherein the length of the front portion and end portion are substantially the same.

8. An asphalt composition roof covering comprising:

an elongated sheet of material having a first end, a second end, a first edge, a second edge, a tapered front portion, a tapered body portion, a tapered end portion and a longitudinal axis;

at least a first fold line at a first juncture of the front portion and the body portion;

at least a third and a fourth fold line in the body portion;

said first end tapering outward to said first juncture to form the widest part of the sheet at the first juncture, the front portion of the sheet being between the first end and the first juncture;

the elongated sheet tapering inwardly from said first juncture to a second juncture of the body portion and the end portion, which second juncture point is the narrowest part of the sheet, the portion between the first juncture and the second juncture being the body portion of the sheet;

the elongated sheet tapering outwardly from the narrowest part of the sheet to the second end, this portion of the sheet being the end portion;

said elongated sheet being folded under the body portion about its first fold line and about its third fold line at fourth fold line on top of the body portion to provided multilayers of said sheet at the wide end of the body portion and in the main part of the body portion.

9. The roof covering of claim 8 wherein the front portion has a second fold line which is folded about the second fold line to form another layer of sheet at the wide end of the body portion.

10. The roof covering of claim 8 wherein the angle of taper of the front portion and the end portion are substantially the same and the length of the front portion and the end portion are substantially the same.

11. The roof covering of claim 8 wherein the folds are held together by the use of an adhesive.

12. The roof covering of claim 11 wherein the adhesive is a hot melt adhesive glue having a melting point above about 220° F.

* * * * *

UNITED STATES PATENT AND TRADEMARK OFFICE

CERTIFICATE OF CORRECTION

PATENT NO. : 5,471,801

DATED : December 5, 1995

INVENTOR(S) : Kupczyk et al.

It is certified that error appears in the above-identified patent and that said Letters Patent is hereby corrected as shown below:

IN THE CLAIMS: ADD THE FOLLOWING CLAIMS:

--13. The method of claim 7, wherein the angle of tapers of the front portion and the end portion are between 8° and 12°.

14. The method of claim 13 wherein the angle of taper of the body portion is about 4° to 7°.

15. The method of claim 14 wherein the length of each article is about 21 inches with the front portion and end portion each having a length of about 3 inches.

16. The method of claim 15 wherein the width of the first juncture is about 9 inches and the width of the second end is about 7 inches.

17. The article of claim 5 wherein the angle of tapers of the front portion and the end portion are between 8° and 12°.

18. The article of claim 17 wherein the angle of taper of the body portion is about 4° to 7°.

19. The article of claim 18 wherein the length of the article is about 21 inches with the front portion and end portion each having a length of about 3 inches.

UNITED STATES PATENT AND TRADEMARK OFFICE

CERTIFICATE OF CORRECTION

PATENT NO. : 5,471,801 Page 2 of 2

DATED : December 5, 1995

INVENTOR(S) : Kupczyk et al.

It is certified that error appears in the above-indentified patent and that said Letters Patent is hereby corrected as shown below:

20. The article of claim 19 wherein the width of the first juncture is about 9 inches and the width of the second end is about 7 inches. - -

Signed and Sealed this

Twenty-seventh Day of February, 1996

*Attest:*

Bruce Lehman

BRUCE LEHMAN

*Attesting Officer*

*Commissioner of Patents and Trademarks*